US010068761B2

(12) United States Patent
Wildgoose

(10) Patent No.: US 10,068,761 B2
(45) Date of Patent: Sep. 4, 2018

(54) FAST MODULATION WITH DOWNSTREAM HOMOGENISATION

(71) Applicant: Micromass UK Limited, Wilmslow (GB)

(72) Inventor: Jason Lee Wildgoose, Stockport (GB)

(73) Assignee: MICROMASS UK LIMITED, Wilmslow (GB)

( * ) Notice: Subject to any disclaimer, the term of this patent is extended or adjusted under 35 U.S.C. 154(b) by 18 days.

(21) Appl. No.: 15/505,793

(22) PCT Filed: Aug. 26, 2015

(86) PCT No.: PCT/GB2015/052466
§ 371 (c)(1),
(2) Date: Feb. 22, 2017

(87) PCT Pub. No.: WO2016/030683
PCT Pub. Date: Mar. 3, 2016

(65) Prior Publication Data

US 2017/0271141 A1 Sep. 21, 2017

(30) Foreign Application Priority Data

Aug. 26, 2014 (EP) ..... 14182222
Aug. 26, 2014 (GB) ..... 1415045.2

(51) Int. Cl.

| | |
|---|---|
| ***H01J 49/42*** | (2006.01) |
| ***H01J 49/06*** | (2006.01) |
| ***H01J 49/26*** | (2006.01) |
| ***H01J 49/00*** | (2006.01) |
| ***H01J 49/04*** | (2006.01) |

(52) U.S. Cl.
CPC ..... *H01J 49/429* (2013.01); *H01J 49/005* (2013.01); *H01J 49/0086* (2013.01); *H01J 49/0422* (2013.01); *H01J 49/06* (2013.01); *H01J 49/26* (2013.01)

(58) Field of Classification Search
USPC ..... 250/281–283, 288, 292, 293, 294, 299, 250/300, 526
See application file for complete search history.

(56) References Cited

U.S. PATENT DOCUMENTS

| | | | | |
|---|---|---|---|---|
| 6,627,912 | B2 | 9/2003 | Bandura et al. | |
| 7,351,957 | B2 | 4/2008 | Bloomfield et al. | |
| 8,093,554 | B2 * | 1/2012 | Makarov | H01J 49/004 250/281 |
| 8,735,811 | B2 * | 5/2014 | Makarov | H01J 49/004 250/281 |
| 8,748,809 | B2 | 6/2014 | Zabrouskov et al. | |
| 8,921,773 | B2 | 12/2014 | Geromanos et al. | |

(Continued)

FOREIGN PATENT DOCUMENTS

JP S56-128558 10/1981

*Primary Examiner* — Bernard Souw

(57) ABSTRACT

A method of mass spectrometry is disclosed involving scanning a parameter of a first device through which a mixture of components is passed. Different components are transmitted through or produced in the first device at different values of the parameter and hence scanning the device parameter introduces a temporal modulation or profile to the components. This temporal variation is then removed prior to mass analyzing the components through a process of homogenization.

20 Claims, 4 Drawing Sheets

(56) References Cited

U.S. PATENT DOCUMENTS

| | | | | |
|---|---|---|---|---|
| 9,000,364 | B2 * | 4/2015 | Ermakov | H01J 49/4245 250/281 |
| 9,299,548 | B2 | 3/2016 | Bonner et al. | |
| 9,443,706 | B2 | 9/2016 | Gilbert et al. | |
| 9,536,717 | B2 | 1/2017 | Makarov et al. | |
| 9,607,820 | B2 | 3/2017 | Bateman et al. | |
| 2002/0166959 | A1 * | 11/2002 | Bandura | H01J 49/0045 250/282 |
| 2010/0051799 | A1 * | 3/2010 | Makarov | H01J 49/004 250/282 |
| 2010/0084549 | A1 * | 4/2010 | Ermakov | H01J 49/4245 250/283 |
| 2010/0301205 | A1 | 12/2010 | Thomson | |
| 2012/0104245 | A1 * | 5/2012 | Makarov | H01J 49/004 250/287 |
| 2014/0183347 | A1 * | 7/2014 | Makarov | H01J 49/004 250/252.1 |
| 2014/0346341 | A1 * | 11/2014 | Giles | H01J 49/0045 250/282 |
| 2015/0380232 | A1 * | 12/2015 | Brown | H01J 49/428 250/282 |

* cited by examiner

FAST MODULATION WITH DOWNSTREAM HOMOGENISATION

CROSS-REFERENCE TO RELATED APPLICATIONS

This application represents the U.S. National Phase of International Application number PCT/GB2015/052466 entitled "Fast Modulation with Downstream Homogenisation" filed 26 Aug. 2015, which claims priority from and the benefit of United Kingdom patent application No. 1415045.2 filed on 26 Aug. 2014 and European patent application No. 14182222.1 filed on 26 Aug. 2014. The entire contents of these applications are incorporated herein by reference.

FIELD OF THE INVENTION

The present invention relates generally to spectrometry and in particular to mass spectrometers and methods of performing mass spectrometry.

BACKGROUND

It is known that different ions (e.g. ions having different mass to charge values) may be optimally transmitted through or produced in a particular device under different operating conditions. It is also known to therefore scan or vary instrument parameters during the course of a mass spectrometry experiment so as to ensure adequate transmission or production of a range of ions of interest. This is particularly common in discovery-type experiments where the components being analysed are not necessarily known a priori.

One example of an instrument parameter that might be scanned in this way would be the collision energy within a fragmentation cell. By ramping collision energy over the course of an experiment a range of different ions can be efficiently fragmented that may not be achievable using any single collision energy.

Various mass spectrometry experiments are known where the collision energy is scanned or ramped to provide broader ion fragmentation coverage. Reference is made, for example, to WO 03/094197 (MDS). A development of this idea is described in WO 2011/091023 (WATERS TECHNOLOGIES CORPORATION) where a collision cell is repeatedly switched between high and low fragmentation modes approximately every second, with the collision energy in the high fragmentation mode also being varied as a function of time. The output of the collision cell is then passed to a mass analyser. A further experiment involving scanning collision energies is described in WO 2012/175978 (MICROMASS) where spectra are repeatedly recorded as the collision energy is scanned from low to high and back again from high to low in order to reduce settling times and avoid spectral skewing.

Other approaches to probing multiple collision energies are described in US 2014/0183347 (THERMO) and WO 2010/120496 (THERMO) wherein ions are passed to an intermediate ion storage unit as a series of discrete 'fills'. Each fill may correspond to a different energy or method of collision activation of a selected precursor ion and the final ion population may thus correspond to an entire range of collision energies. However, all of the ions in each fill experience the same conditions and it will be appreciated, therefore, that in these experiments the changing the collision energy does not itself introduce any temporal modulation to different components of an ion beam.

Another example of an instrument parameter that might be scanned would be an RF potential applied to an ion guide being varied to transmit a different range of mass to charge values.

It is desired to provide an improved method of mass spectrometry.

SUMMARY

According to an aspect, there is provided a method of mass spectrometry comprising:

passing an ion beam containing a mixture of components through a first device;

recording a mass spectrum of at least some of the components with a single spectrum production time Ts;

during a single spectrum production cycle, scanning a parameter of the first device over a range of values with a cycle time $T1<Ts$;

wherein different components are transmitted through or produced in the first device at different values of the parameter such that scanning the parameter introduces a temporal modulation or profile to the components; and prior to recording the mass spectrum, substantially removing or altering the temporal modulation or profile by converting the temporally modulated components into a substantially continuous or pseudo-continuous ion beam.

It has been recognised that various problems arise where a temporally modulated ion beam is to be analysed. Particularly, problems may arise if the temporal profile is maintained as the components arrive at the ion detection or acquisition system. For example, in Time of Flight ("TOF") mass analysis (or other discontinuous analyses) temporal variations in the ion beam may reduce the dynamic range of the instrument. Another problem associated with different components being concentrated in time as they arrive at a downstream device is that it may be difficult to sample or record all of the components of interest. This is particularly true for downstream devices or analysers having relatively short transmission windows or fill times, as the transmission window may not overlap with the temporal profile of a given component. Furthermore, the temporal profile of the component(s) may be inadvertently synchronised with other time-varying devices or instrument parameters. This may introduce a bias to the measurement or transmission of ions.

Various embodiments seek to remove or alter the temporal profile(s) introduced by scanning a parameter of the first device prior to recording a mass spectrum of the components. That is, the problems described above, and other problems resulting from scanning a parameter of a device, may be avoided by ensuring that the fidelity of any unwanted temporal modulation is destroyed or lost prior to recording a spectrum. This may be achieved according to various embodiments by scanning the device parameter with a relatively short or fast cycle time (T1) in combination with downstream homogenisation of the ion beam. A suitable cycle time T1 may be determined or selected to ensure that the resulting modulation can be substantially removed or altered prior to recording the mass spectrum.

In the techniques described herein the scan cycle time may be relatively short compared to known techniques involving scanning parameters such as collision energies. This helps facilitate removal of the resulting modulation, i.e. the cycle time may be chosen such that the modulated components can be readily converted into a substantially continuous or pseudo-continuous ion beam (i.e. homogenised). However, it will be appreciated that the scan cycle time need not be especially short, provided that suitable means are arranged for removing the resulting modulation.

By removing or altering the temporal modulation of the components in this way it is possible, for example, to enhance the dynamic range of a Time of Flight mass analyser downstream of the modulating device (that is the device that introduces a temporal profile to the ion beam). This techniques described herein may also enable improved sampling of a temporally modulated ion beam by analysers employing reduced fill times such as ion trap mass analysers employing automatic gain control ("AGC").

The parameter being scanned or varied may be referred to as an operating parameter of the device. The parameter may be scanned or varied in order to transmit or produce a range of different ions or components of interest. Scanning a parameter over a range of values generally involves scanning the parameter over two or more different values. It may involve scanning the parameter between two or more non-zero values. The parameter may be scanned between first and second values, wherein a first set of components or ions is produced or transmitted at a first value of the parameter and a second set of components or ions is produced or transmitted at a second value of the parameter. The first and second sets will generally be different although some components or ions may appear in both sets. Scanning the parameter during the spectral production cycle means that components that have been transmitted or produced at different values of the parameter may appear in a single spectrum.

Scanning a parameter over a range of values does not include switching an ion attenuation device ON and OFF. Switching an ion attenuation device ON and OFF does not result in a range of different ions being differentially transmitted or produced.

A temporal modulation or profile may be any temporal variation or discontinuity in intensity introduced by scanning the parameter of the first device. This temporal modulation may be introduced because different components of the ion beam may be transmitted or produced in the first device under different conditions i.e. at different values of the (operating) parameter. The ion beam typically contains a mixture of components i.e. a range of different ions having different physico-chemical properties, for instance, different mass to charge values. Each component or mass to charge value may have a different temporal profile, although the temporal profiles of different components may overlap. It will be appreciated that the total temporal extent or width of the modulation for all of the components will thus essentially be determined by i.e. equal to the scan cycle time. The temporal profile resulting from scanning the operating parameter may be deterministic or non-deterministic. For instance, ions having different mass to charge values may be transmitted through an RF ion guide at different RF values in which case scanning the RF value would result in a mass to charge range dependent temporal profile.

It is not necessary that all of the components are temporally modulated. In some situations some of the components may be equally transmitted (or not) at all values being scanned. These components would not be temporally modulated.

Removing the temporal modulation by converting the components into a substantially continuous ion beam (or in other embodiments a substantially homogeneous ion packet) may be referred to as homogenisation. Removing the temporal modulation or profile may mean substantially removing or reducing the temporal modulation or profile so that the effect of the modulation is essentially invisible to a user i.e. has no effect on the recording of the mass spectrum. That is, substantially removing the temporal modulation or profile may mean removing the effects of the temporal modulation. For instance, the temporal modulation or profiles of the components may be removed or altered such that the temporal profiles of different components may be caused to merge or overlap or may be otherwise homogenised such that each component can be simultaneously recorded or sampled. That is, the temporal profiles of each of the different temporally modulated components may be extended or smoothed out and converted into a substantially continuous or pseudo-continuous ion beam wherein each of the components has a similar or overlapping temporal profile.

A substantially continuous or pseudo-continuous ion beam is one that has substantially no discontinuities in intensity over the timescale for which it is transmitted or measured e.g. for a timescale at least equal to the scan cycle time. A substantially continuous or pseudo-continuous ion beam may have a substantially flat or homogeneous profile i.e. with no significant variations in intensity for each of the components. However, it is not necessary for the temporal profile for each of the components to be flat provided that at least some of each component of interest is present at the time where the ion beam is sampled or recorded. The total ion current at a particular time will contain contributions from each of the components present at that time. Where the components are temporally modulated less than all of the components may contribute to the ion current at any time. The effect of the homogenisation process is that substantially all of the components contribute to the total ion current for the duration of the (pseudo) continuous ion beam. That is, the temporal profile for each i.e. all of the components may be substantially continuous or pseudo-continuous. As described below, the temporally modulated components may be converted to a substantially continuous or pseudo-continuous ion beam through scattering, diffusive spreading and/or using time and/or position varying electric fields.

The single spectrum production time is the total experimental cycle time to record a single mass spectrum. The total experimental cycle time includes the time for a mass analyser to produce a single mass spectrum. The cycle time T1 may be shorter than the spectral production time of the mass analyser. A single mass spectrum is recorded within each spectral production cycle and the cycle may be repeated to record multiple mass spectra. For instance, multiple nested mass spectra may be recorded during the course of an upstream separation e.g. a chromatographic or ion-mobility separation. In these cases, the single spectrum production time may be the time to record each (nested) mass spectrum. The spectral production cycle time will be determined e.g. by the type of analyser, the scan range and the resolution of the instrument. The cycle time T1 will typically be significantly shorter than the spectral production time Ts. For instance, T1 may be short enough to allow multiple parameter scans within a single spectral production cycle. T1 may be less than about 50%, less than about 40%, less than about 30%, less than about 20%, or less than about 10% of the spectral production cycle.

Recording a mass spectrum typically involves measuring or detecting a range of ions. However, in some instruments or experiments a single ion may be selected for measuring. For instance, in a parent or precursor ion scanning tandem mass spectrometry experiment a single fragment ion will be monitored whilst a range of parent or precursor ions are scanned. In the context of the present disclosure measuring or recording this single peak constitutes recording a spectrum.

After having passed through the first device, the ion beam may be passed to a mass analyser or ion detection or acquisition system that records a mass spectrum. The mass analyser may be downstream of the first device in a linear geometry. Other instrument geometries where the ion beam may be passed back upstream through the first device and into an orthogonal mass analyser are also contemplated.

The method may comprise converting the temporally modulated components into a substantially continuous or pseudo-continuous ion beam by passing the components through or along a gas-filled homogenisation device.

The gas-filled homogenisation device or homogeniser has the effect of smoothing any temporal intensity variations of components passing through it. This may be achieved through interactions between ion beam components and the gas in the homogenisation device. Collisions with the background gas may cause ions to scatter and to diffusively spread within the homogenisation device thereby reducing or removing any temporal modulation or profile. Thus, the homogenisation device may be any suitable device that is arranged and adapted to substantially remove or alter any temporal profile in an ion beam passing into or through the homogenisation device. Generally, the length of the device, or the effective length of the ion path through the device and/or the nature and pressure of the background gas may be selected to ensure that an ion beam is sufficiently homogenised. As described below, one or more electric fields may also be applied to the device to facilitate homogenisation of the components. Naturally, the extent of homogenisation required will depend on the extent of the temporal modulation and is thus dependent on the cycle time T1. For shorter cycle times, the extent of the temporal modulation is lower such that the beam can be more readily homogenised.

The method may comprise converting the temporally modulated components into a substantially continuous or pseudo-continuous ion beam by:

(i) allowing the temporally modulated components to diffusively spread within the gas-filled homogenisation device; and/or (ii) applying one or more time and/or position varying electric fields to the gas-filled homogenisation device.

The gas-filled homogenisation device may rely solely on passive diffusion, in which case the cycle time T1 should be short enough to ensure that the components diffuse sufficiently to smooth the temporal profile. Additionally/alternatively one or more time and/or position varying electric fields may be used to effect or enhance homogenisation of the ion beam. A mass spectrometer may comprise means for applying these fields to the gas-filled homogenisation device. The fields may be applied to a plurality of electrodes constituting the gas-filled homogenisation device.

The one or more time and/or position varying electric fields may be arranged to actively convert the temporally modulated components into a substantially continuous or pseudo-continuous ion beam. Additionally/alternatively, the one or more time and/or position varying electric fields may be arranged to reduce, further reduce, or remove any temporal modulation from the ion beam by controlling the interactions between the components of the ion beam and the gas in the homogenisation and/or by controlling the time for which components of the ion beam are present in the homogenisation device. Controlling the ion-gas interactions may comprise changing the rate of interactions or the velocity of the components.

For example, the one or more time and/or position varying electric fields may comprise transient DC voltages or voltage waveforms (e.g. travelling waves) applied to a plurality of electrodes forming the gas-filled homogenisation device. These transient DC voltages or voltage waveforms may be used to temporarily confine and/or manipulate ions within the gas-filled homogenisation device. In this way, the position and/or velocity and/or interactions of the ions can be manipulated or controlled such that the temporal modulation is removed. The fields may be arranged to partition different components (having different temporal profiles) and then gradually remove or merge the partitions. In this way, the temporally modulated components can be smoothed into a continuous or pseudo-continuous ion beam.

The use of time and/or position varying electric fields to homogenise the ion beam, or to control or reduce the time needed to homogenise an ion beam, may be referred to as active homogenisation. It is noted that the one or more time and/or position varying electric fields are not limited to travelling waves (i.e. one or more transient DC voltages). According to various embodiments, one or more axial DC gradients and/or RF or AC fields may also be arranged to actively homogenise the ion beam. Active homogenisation may reduce the time required to remove a temporal profile from an ion beam and/or allow greater control relative to devices relying on passive diffusion alone.

A linear acceleration field e.g. a constant DC voltage gradient may be maintained along at least a portion of the gas-filled device or additionally/alternatively one or more transient DC voltages or potentials may be applied to the electrodes forming the gas-filled device in order to drive or urge ions through the device. This may reduce the transit time of ions through the device.

Where electric fields are used to actively homogenise the ion beam and/or to urge ions through the device, the characteristics of the electric fields may be arranged such that loss of temporal modulation occurs.

The components may be passed through multiple gas-filled homogenisation devices the combined effect of which may be to destroy or remove the temporal profile from the ion beam prior to its measurement.

The gas-filled device may be operated at a relatively high pressure to provide a high rate of scattering and/or diffusion. A relatively high pressure may be a pressure greater than about $10^{-3}$ mbar.

In embodiments, the gas-filled homogenisation device may comprise:

(i) a gas cell;

(ii) a gas-filled RF or AC device;

(iii) an ion guide, ion guiding region or ion funnel; or (iv) a fragmentation or reaction cell.

In embodiments, the gas-filled homogenisation device may:

(i) constitute or is the first device, (ii) be disposed downstream of the first device and/or between the first device and an ion detection or acquisition system or mass analyser; or (iii) constitute or is an ion detection or acquisition system or mass analyser.

Where the gas-filled device constitutes the first device, the first device may be arranged to homogenise the ion beam after the temporal modulation has been introduced.

Where the gas-filled device constitutes the ion detection or acquisition system or mass analyser the ion beam may be homogenised prior to the step of recording the components. This may involve homogenising the beam prior to its arrival at an ion detecting component or before a measurement is started. The modulation may be lost as part of the acquisition process e.g. where an ion trap mass analyser is used.

The gas-filled device may comprise one or more ion guides or one or more gas collision cells. The one or more ion guides or gas collision cells may be maintained, in use, at a pressure selected from the group consisting of: (i) <about 0.001 mbar; (ii) between about 0.001-0.005 mbar; (iii) between about 0.005-0.01 mbar; (iv) between about 0.01-0.05 mbar; (v) between about 0.05-0.1 mbar; (vi) between about 0.1-0.5 mbar; (vii) between about 0.5-1 mbar; and (viii) >about 1 mbar. According to other embodiments the one or more ion guides or gas collision cells may be provided at other pressures to those detailed above. According to an embodiment one or more axial DC potential gradients may be maintained along at least about 5%, 10%, 15%, 20%, 25%, 30%, 35%, 40%, 45%, 50%, 55%, 60%, 65%, 70%, 75%, 80%, 85%, 90%, 95% or 100% of the axial length of the one or more ion guides or gas collision cells. According to an embodiment one or more time varying DC potentials or DC potential waveforms may be applied to at least a portion of the one or more ion guides or gas collision cells so that at least some ions are urged along the one or more ion guides or gas collision cells. According to an embodiment one or more axial trapping regions may be provided within the one or more ion guides or gas collision cells and the one or more axial trapping regions may be translated along at least a portion of the one or more ion guides or gas collision cells. The one or more ion guides or gas collision cells may be selected from the group consisting of: (i) an RF or AC multipole rod set ion guide or gas collision cell; (ii) a segmented RF or AC multipole rod set ion guide or gas collision cell; (iii) an RF or AC ion tunnel ion guide or gas collision cell comprising a plurality of electrodes having apertures through which ions are transmitted in use and wherein optionally at least about 50% of the electrodes have substantially similar sized apertures; and (iv) an RF or AC ion funnel ion guide or gas collision cell comprising a plurality of electrodes having apertures through which ions are transmitted in use and wherein optionally at least about 50% of the electrodes have apertures which become progressively larger or smaller. Other embodiments are contemplated wherein the ion tunnel ion guide or gas collision cell may be such that less than about 50% of the electrodes have substantially similar sized apertures. Similarly, embodiments are contemplated wherein the ion funnel ion guide or gas collision cell is such that less than about 50% of the electrodes have apertures which become progressively larger or smaller.

According to another aspect, there is provided a method of mass spectrometry comprising:

passing an ion beam containing a mixture of components through a first device;

recording a mass spectrum of at least some of the components with a single spectrum production time Ts;

during a single spectrum production cycle, scanning a parameter of the first device over a range of values with a cycle time T1<Ts;

wherein different components are transmitted through or produced in the first device at different values of the parameter such that scanning the parameter introduces a temporal modulation or profile to the components; and prior to recording the mass spectrum, substantially removing or altering the temporal modulation or profile by converting the temporally modulated components into a substantially homogeneous ion packet.

The temporally modulated components may be converted into a substantially homogenous ion packet by passing the components into or through an ion trap or ion accumulation device.

The effect of converting the components into a substantially homogeneous ion packet is that any prior temporal profile or modulation of the ions constituting the packet is removed or altered. A homogeneous ion packet may be a single ion packet containing multiple or all of the components of interest. Each of the components within a homogenous ion packet may have similar or overlapping (average) spatial and/or temporal profiles.

The spatial and/or temporal profiles of any components confined within the ion trap or ion accumulation device may substantially overlap i.e. to form a single substantially homogeneous ion packet. Any prior temporal modulation of the components confined within the ion trap may thus be removed or altered due to the spatial confinement of the ions and/or as a result of collisional cooling with the trap.

The ion trap may be operated with automatic gain control.

The ion trap may be arranged downstream of the first device and/or may constitute a mass analyser. Ions may be temporarily stored within the ion trap and then released for further analysis or they may be analysed within the ion trap. In the latter case, where the ion trap constitutes part of an ion detection or acquisition system or a mass analyser, the ions may be collisionally cooled prior to the step of recording the spectrum.

The ion trap or ion accumulation device may have a fill time or transmission window Tf, wherein Tf<Ts. Tf may be shorter than T1 e.g. where an ion trap or accumulation device is used in combination with a gas-filled homogenisation device such that a substantially continuous ion beam is provided to the ion trap or accumulation device.

To ensure that all of the components are homogenised, the ion trap may be arranged to sample the full width of the temporal modulation of the ion beam (i.e. of all of the components of the ion beam). Accordingly, the ion trap or ion accumulation device may have a fill time or transmission window Tf, wherein T1≤Tf<Ts.

In embodiments, the cycle time T1 may be less than about: (i) 10 ms; (ii) 5 ms; (iii) 2 ms; or (iv) 1 ms.

The cycle time T1 should generally be short enough so that the ion beam can be completely homogenised i.e. the temporal modulation removed or altered. The upper limit for the cycle time T1 may be determined based on the characteristics of and/or conditions within any (homogenisation) devices along the ion beam path. Suitable cycle and spectral production times may for instance be pre-programmed into an instrument for a particular mode of operation. Additionally or alternatively a user may select appropriate parameter scan cycle and spectral production times for a particular experiment.

The cycle time T1 may be selected to enhance the dynamic range of the mass analyser and/or to ensure that substantially all of the components of said beam of ions are sampled or recorded. The cycle time T1 may be determined from prior calibration experiments or extrapolated from programmable dynamic range enhancement data. A cycle time T1 less than about 10 ms may be suitable when using travelling wave or axial field driven homogenisation devices. For relatively fast instruments, with short spectral production and inter scan times, cycle times of less than about 2 ms, and even less than about 1 ms, have been found to produce good experimental results i.e. enhanced dynamic range.

It is noted that the cycle times may be higher e.g. when using other homogenisation devices or when using an ion trap or ion accumulation device.

The methods may further comprise passing the ion beam to a mass analyser for recording said mass spectrum, in which case the temporally modulated components may be converted into a substantially continuous or pseudo-continuous ion beam and/or a substantially homogeneous ion packet before the ion beam is passed to the mass analyser.

In embodiments, the method may comprise matching the cycle time T1 to a transmission window, extraction window or fill time, Tf, of a second device disposed downstream of the first device so that $T1 \leq Tf < Ts$.

Matching means that one or more complete cycles can be performed during the transmission or extraction window or fill time. The second device may be an ion trap operating with automatic gain control.

In embodiments, the method may comprise scanning the parameter of the first device multiple times during the single spectrum production cycle.

The parameter may be repeatedly scanned over the same range so that each cycle has substantially the same start and end point. The cycle time T1 may be defined as the time between adjacent scans. Each of the multiple scans introduces a temporal profile to the components resulting in an overall temporal modulation with a period determined by the scan cycle time T1.

In embodiments, the first device may comprise:

(i) a collision cell wherein optionally the parameter is collision energy;

(ii) a fragmentation or reaction cell wherein optionally the parameter is a fragmentation or reaction parameter;

(iii) an ion guide wherein optionally the parameter is a DC, AC or RF potential that controls or changes ion transmission through the ion guide; or (iv) an ion filter wherein optionally the parameter is a DC or RF potential that controls or changes ion transmission through the ion filter.

The collision, fragmentation or reaction cell may generally be selected from the group described below. Where the first device is a collision, fragmentation or reaction cell the ion beam passed into the first device may comprise parent or precursor ions and the components may comprise fragment or product ions derived from the parent or precursor ions. In these cases the mass spectrum may comprise a fragment or product ion spectrum.

Scanning an RF potential of an ion guide filter may control the mass to charge range of ions being transmitted. This will generally result in a mass to charge range dependent temporal profile.

In embodiments, the method may comprise passing the components from the first device onwards to a mass analyser for recording the mass spectrum, wherein the mass analyser is optionally selected from the group comprising: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser. In particular embodiments described herein, the mass analyser may comprise a Time of Flight mass analyser or an ion trap mass analyser operating with AGC.

In embodiments, the step of scanning the parameter may comprise increasing, decreasing or varying the parameter in a linear, non-linear, or stepped manner.

Increasing the parameter may also be referred to as ramping.

In embodiments, the method may comprise scanning a second parameter of the first device and/or of a further device through which the ion beam passes with a cycle time T2, wherein $T2 \neq T1$.

The further device may comprise any device along the ion path such as a further ion guide or reaction or fragmentation cell or a mass analyser.

Multiple operating parameters (which may be associated with multiple devices) may be scanned or varied during the course of a single spectral acquisition. Removing the temporal modulation resulting from at least the first parameter scan may prevent an inadvertent synchronisation of the first and second parameter scans. It may not be necessary to homogenise the ion beam after both parameter scans.

According to another aspect there is provided a mass spectrometer comprising:

a first device having a variable operating parameter;

a mass analyser that records a mass spectrum of ions after they have passed through the first device with a single spectrum production time Ts;

a control system arranged and adapted to: scan the parameter of the first device with a cycle time $T1 < Ts$ during a single spectrum production cycle, wherein different components are transmitted through or produced in the first device at different values of the parameter such that scanning the parameter introduces a temporal modulation or profile to the components; and one or more homogenisation devices for converting the temporally modulated components into a substantially continuous or pseudo-continuous ion beam such that the temporal modulation or profile is removed or altered prior to recording the mass spectrum.

According to another aspect there is provided a mass spectrometer comprising:

a first device having a variable operating parameter;

a mass analyser that records a mass spectrum of ions after they have passed through the first device with a single spectrum production time Ts;

a control system arranged and adapted to scan the parameter of said first device with a cycle time $T1 < Ts$ during a single spectrum production cycle, wherein different components are transmitted through or produced in the first device at different values of the parameter such that scanning said parameter introduces a temporal modulation or profile to the components; and a device for converting the temporally modulated components into a substantially homogeneous ion packet such that said temporal modulation or profile is substantially removed or altered prior to recording said mass spectrum.

The mass spectrometer and the devices constituting the mass spectrometer in these further aspects may comprise or constitute any or all of the above-described features as appropriate. In particular, the control system may be arranged and adapted to perform any of the method steps described above.

According to another aspect there is provided a method of mass spectrometry comprising:

passing an ion beam through a first device;

during a single spectrum production cycle, scanning a parameter of the first device multiple times over a range of values with a cycle time T1, wherein different components are transmitted through or produced in the first device at different values of the parameter such that scanning the parameter introduces a temporal modulation or profile to the components;

passing the temporally modulated components through or along a gas-filled homogenisation device to substantially remove or alter the temporal modulation or profile; and then recording a mass spectrum of at least some of the components.

The homogenisation device may convert the temporally modulated components into a substantially continuous or pseudo-continuous ion beam or a substantially homogeneous ion packet.

According to another aspect there is provided a mass spectrometer comprising:

a first device having a variable operating parameter;

a mass analyser that records a mass spectrum of ions after they have passed through the first device;

a control system arranged and adapted to during a single spectrum production cycle, scan the parameter of the first device multiple times with a cycle time T1, wherein different components are transmitted through or produced in the first device at different values of the parameter such that scanning the parameter introduces a temporal modulation or profile to the components; and one or more homogenisation devices for substantially removing or altering said temporal modulation or profile from the components prior to their mass analysis.

The method of mass spectrometry and mass spectrometer of these aspects may contain any or all of the features described in relation to the other aspects, at least to the extent that they are not mutually incompatible.

According to another aspect there is provided a method of mass spectrometry comprising:

passing an ion beam containing a mixture of components through a first device;

recording a mass spectrum of at least some of the components with a single spectrum production time Ts;

during a single spectrum production cycle, scanning a parameter of the first device over a range of values with a cycle time T1<Ts, wherein different components are transmitted through or produced in the first device at different values of the parameter such that scanning the parameter introduces a temporal modulation or profile to the components; and selecting or determining the cycle time T1 such that the temporal modulation or profile is removed or altered prior to recording the mass spectrum.

In embodiments, the method may comprise substantially removing or altering the temporal modulation or profile by converting the temporally modulated components into a substantially continuous or pseudo-continuous ion beam.

In embodiments, the method may comprise removing the temporal modulation or profile by converting at least some of the temporally modulated components into a substantially homogeneous ion packet.

According to another aspect there is provided a method of mass spectrometry comprising:

passing a beam of ions containing a mixture of components through a first device and onwards to an ion trap or ion accumulation device, wherein the ion trap or ion accumulation device has a fill time Tf;

recording a mass spectrum of at least some of the ions with a single spectrum production time Ts, wherein Tf<Ts;

during a single spectrum production cycle, scanning an operating parameter of the first device with a cycle time T1<Ts.

In embodiments, the cycle time T1≤Tf.

This may result in the components being converted into a single substantially homogeneous ion packet.

In embodiments, the method may comprise scanning the operating parameter multiple times within the spectral production time Ts.

In embodiments, the method may comprise scanning the operating parameter multiple times within the fill time Tf of the ion trap or ion accumulation device.

In embodiments, different components are transmitted through or produced in the first device at different values of the parameter such that scanning said parameter introduces a temporal modulation or profile to said components; and the method may comprise, prior to passing said components to said ion trap or ion accumulation device, substantially removing or altering said temporal modulation or profile by converting the temporally modulated components into a substantially continuous or pseudo-continuous ion beam.

According to another aspect there is provided a method of mass spectrometry comprising:

passing a beam of ions through a first device;

recording a single mass spectrum of at least some of the ions with a spectral production time; and during a single spectrum production cycle, scanning a parameter of the first device with a cycle time T1.

The cycle time T1 may be shorter than the spectral production time, i.e. T1<Ts.

In embodiments, the method may comprise scanning the operating parameter multiple times during the single spectrum production cycle.

In embodiments, the method may comprise matching the cycle time to a fill time or transmission window, Tf, of a second device disposed downstream of the first device.

In embodiments, the method may comprise substantially removing or reducing a temporal profile of the beam of ions or of the components of the beam of ions resulting from the step of scanning the operating parameter.

In embodiments, the method may comprise converting the beam of ions into a substantially continuous or pseudo-continuous ion beam and/or a substantially homogeneous ion packet prior to recording the spectrum.

According to another aspect there is provided a mass spectrometer comprising:

a first device having a variable operating parameter;

a mass analyser that records a spectra of ions after they have passed through the first device with a single spectrum production time; and a control system arranged and adapted to scan the parameter of the first device during a single spectral production cycle with a cycle time T1, In embodiments, the cycle time T1 may be selected or determined such that a temporal modulation or profile of the components or of the beam of ions resulting from the step of scanning the operating parameter is substantially lost or removed or altered prior to recording the spectrum.

The aspects described above may be combined with and are generally compatible with any or all of the other features described above.

The techniques described herein may extend to other forms of spectrometry, for instance ion mobility spectrometry.

According to another aspect there is provided a method of spectrometry comprising:

passing an ion beam through a first device;

recording a spectrum of components of the ion beam with a single spectrum production time Ts;

during a single spectrum production cycle, varying or scanning a parameter of the first device with a cycle time T1<Ts.

According to another aspect there is provided a spectrometer comprising:

a first device having a variable operating parameter;

an ion detection or acquisition system that records a spectrum of ions after they have passed through the first device with a single spectrum production time Ts; and a control system arranged and adapted to vary or scan the operating parameter of the first device during a single spectrum production cycle with a cycle time T1<Ts.

These aspects may be combined with and are compatible with any or all of the previously described features except wherein the mass spectrum and mass analyser are replaced with spectrum and ion acquisition or detection system.

According to another aspect there is provided a method of mass spectrometry comprising:

(i) varying, ramping or stepping one or more device parameters so that the cycle time of the varying, ramping or stepping is less than 10 ms;

(ii) producing a single spectra so that the fidelity of the resulting modulation is lost.

The method may comprise repeating the step of varying, ramping or stepping more than once in a single spectra production cycle time.

The resultant modulation may be homogenised prior to injection into a mass spectrometer.

The cycle of varying, ramping or stepping may be synchronised with the fill time of an automatic gain control algorithm.

The step of varying, ramping or stepping may occur multiple times within the fill time of an automatic gain control algorithm.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap;

(iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

According to an embodiment analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c)

the reagent ions or negatively charged ions comprise azobenzene anions or azobenzene radical anions.

According to an embodiment the process of Electron Transfer Dissociation fragmentation comprises interacting analyte ions with reagent ions, wherein the reagent ions comprise dicyanobenzene, 4-nitrotoluene or azulene.

A chromatography detector may be provided wherein the chromatography detector comprises either:

a destructive chromatography detector optionally selected from the group consisting of (i) a Flame Ionization Detector (FID); (ii) an aerosol-based detector or Nano Quantity Analyte Detector (NQAD); (iii) a Flame Photometric Detector (FPD); (iv) an Atomic-Emission Detector (AED); (v) a Nitrogen Phosphorus Detector (NPD); and (vi) an Evaporative Light Scattering Detector (ELSD); or a non-destructive chromatography detector optionally selected from the group consisting of: (i) a fixed or variable wavelength UV detector; (ii) a Thermal Conductivity Detector (TCD); (iii) a fluorescence detector; (iv) an Electron Capture Detector (ECD); (v) a conductivity monitor; (vi) a Photoionization Detector (PID); (vii) a Refractive Index Detector (RID); (viii) a radio flow detector; and (ix) a chiral detector.

The mass spectrometer may be operated in various modes of operation including a mass spectrometry ("MS") mode of operation, a tandem mass spectrometry ("MS/MS") mode of operation, a mode of operation in which parent or precursor ions are alternatively fragmented or reacted so as to produce fragment or product ions, and not fragmented or reacted or fragmented or reacted to a lesser degree, a Multiple Reaction Monitoring ("MRM") mode of operation, a Data Dependent Analysis ("DDA") mode of operation, a Data Independent Analysis ("DIA") mode of operation, a Quantification mode of operation or an Ion Mobility Spectrometry ("IMS") mode of operation.

BRIEF DESCRIPTION OF THE DRAWINGS

Various embodiments together with other arrangements given for illustrative purposes only will now be described, by way of example only, and with reference to the accompanying drawings in which.

DETAILED DESCRIPTION

A conventional arrangement will first be described with reference to FIG. 1.

Figure 1:
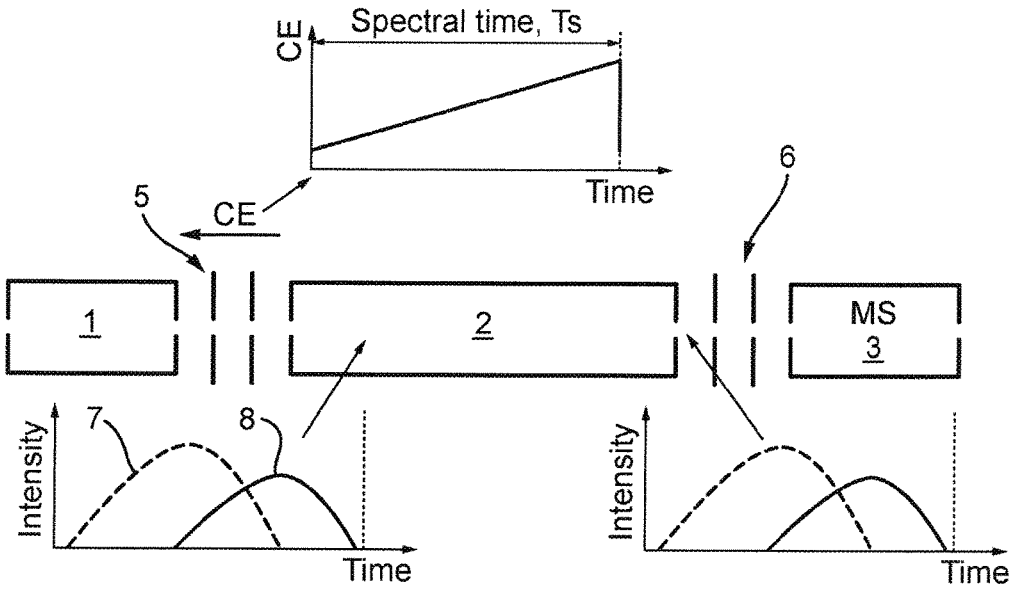
Fig. 1 Prior art
FIG. 1 shows schematically a mass spectrometer being operated in a conventional manner.

FIG. 1 shows schematically an experiment in accordance with a conventional arrangement in which the collision energy of a fragmentation cell 2 is ramped. In the conventional experiment shown in FIG. 1, the collision energy is linearly ramped over the period of a spectral acquisition time Ts (i.e. the time to produce a single spectrum). This is shown in the uppermost graph.

In the instrument depicted in FIG. 1, ions generated by an ion source 1 are accelerated through a number of lenses 5 into the fragmentation cell 2. The fragmentation cell 2 is filled with gas and is maintained at a high enough pressure such that ions accelerated into or through the fragmentation cell 2 may undergo collisional-induced dissociation ("CID"). The collision energy is determined by the accelerating potential between the lenses 5 and the fragmentation cell 2. By increasing this accelerating voltage the collision energy can be ramped. The resulting fragment ions are then passed through ion optics 6 into a mass analyser 3.

Different ions may start to fragment at different collision energies such that the result of scanning the collision energy is that fragment ions are generated in the gas cell 2 with different temporal profiles. The temporal intensity profiles resulting from scanning the collision energy over the period of the acquisition time for two different fragment ions 7,8 are illustrated in the lower left graph of FIG. 1. It can be seen that the fragment ion with intensity profile 7 (the dashed line) is produced at relatively low collision energies whilst the fragment ion with intensity profile 8 (the solid line) only starts to be produced at higher collision energies.

Although some of the fidelity of the modulation may be lost during the ion transit and acquisition process, because the ramp duration in FIG. 1 is relatively long, the temporal intensity profiles of the fragment ions 7,8 are at least partially maintained as the ions arrive at the mass analyser 3. Ions thus arrive at the mass analyser 3 over the period of the acquisition time in a temporally modulated manner. The ion arrival profiles in FIG. 1 are illustrated in the lower right graph.

This temporal modulation leads to various problems. For instance, the mass analyser 3 may comprise a Time of Flight ("TOF") mass analyser e.g. an orthogonal acceleration Time of Flight mass analyser. In Time of Flight detection or acquisition systems, ions are repeatedly pushed into the Time of Flight region during the course of an acquisition. The ions separate according to mass in the Time of Flight region and a mass spectrum is then recorded based on the arrival times of ions at a detector component. In the situation illustrated in FIG. 1, the ions arrive at the push region of the Time of Flight system concentrated in time. This has a detrimental effect on the dynamic range of the instrument because full use is not made of all of the available pushes.

Figure 2:
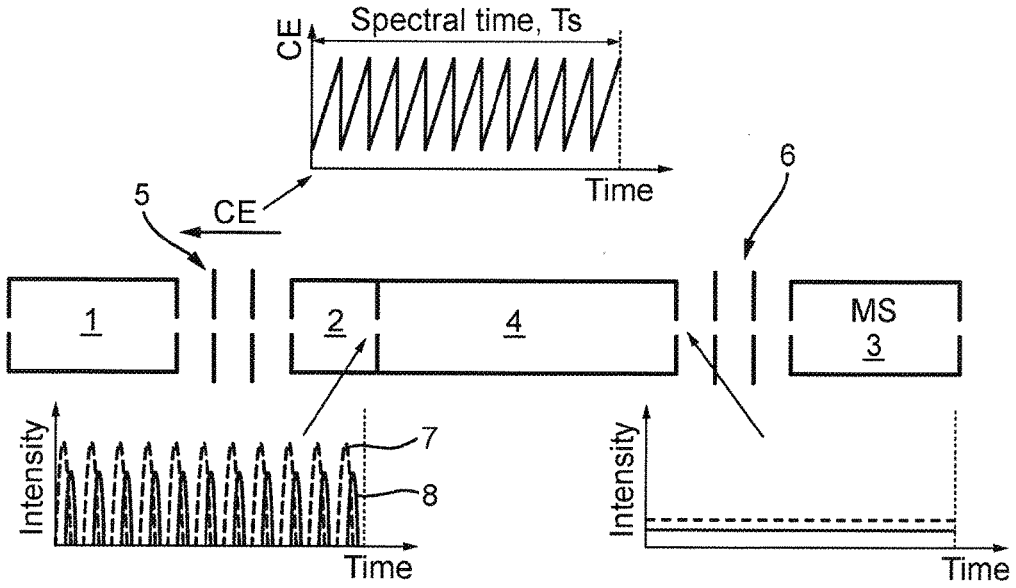
FIG. 2 shows schematically a mass spectrometer being operated in accordance with an embodiment.

FIG. 2 illustrates the improvements made possible through the techniques described herein according to various embodiments. The instrument geometry is similar to that shown and described above with reference to FIG. 1 except that an additional homogenisation device 4 is disposed between the fragmentation cell 2 and the mass analyser 3.

In the embodiment illustrated by FIG. 2 the collision energy is scanned with a cycle time short enough to allow downstream homogenisation of the components being analysed. The collision energy ramping is illustrated in the uppermost graph of FIG. 2. The collision energy is ramped multiple times during the course of the spectral cycle time. It is noted that the spectral cycle times (i.e. the timescales on the graphs) are the same in each of the figures. The result of the repeated collision energy ramping/cycling is that the intensity profiles of fragment ions exiting the fragmentation cell 2 are temporally modulated at a relatively high frequency. The intensity profiles 7,8 for the same two fragment ions illustrated above resulting from this fast modulation are shown in the lower left graph.

The modulated ions are then passed to a homogenisation device 4 which converts or smoothes the temporally modulated ion beam components into a substantially continuous or pseudo-continuous ion beam before being presented to the mass analyser 3. The intensity profiles of the two fragment ions arriving at the mass analyser 3 are illustrated in the lower right graph. It can be seen that the result of the homogenisation process is that a continuous beam of ions for each mass to charge value or component enters the mass analyser 3. The problems described above can thus be alleviated. For instance, where the mass analyser 3 is a Time of Flight mass analyser, because ions are continuously provided to the extraction region full use can be made of each push and the dynamic range can be maximised or enhanced.

The homogenisation device 4 can take a variety of forms so long as it is capable of removing a temporal profile resulting from the parameter scan prior to the ions being recorded by the mass analyser 3. For instance, the homogenisation device 4 may comprise a relatively high pressure ion guide or gas collision cell. In this case collisions with the background gas cause ions to scatter and diffusively spread. The diffusive spreading of ions within the homogenisation device 4 smoothes out or removes any temporal variation so that the fidelity of the temporal modulation is removed or altered. Gas cells or gas-filled RF devices may be particularly useful for beam-based instruments such a quadrupole Time of Flight or tandem quadrupole mass spectrometers. The time required to homogenise an ion beam generally depends on the extent or width of the temporal modulation and on the conditions within the homogenisation device 4.

The width of the total temporal intensity profile of the ion beam (i.e. of all of the components) resulting from each parameter scan will be determined by the cycle time i.e. the duration of the ramp for which the parameter (e.g. collision energy) is scanned for. A relatively short scan cycle time will result in a relatively narrow intensity profile and where the scan cycle is repeated multiple times, a relatively short scan cycle time will result in a relatively high frequency temporal modulation. To allow the ion beam to be homogenised downstream of the device that is being scanned (e.g. collision cell 2) it is important that a sufficiently short or fast scan cycle time is used.

The time required to homogenise the ion beam, which determines the upper limit for the parameter scan cycle time, will depend on the conditions in the homogenisation device 4. For instance, the nature of and the pressure of the gas within the homogenisation device 4 as well as any applied electrostatic confining or driving forces may affect the ion-gas interactions in the homogenisation device 4. The ions must be present in the homogenisation device 4 long enough to ensure that they can sufficiently diffusively spread.

The homogenisation device 4 may rely solely on passive diffusion or spreading of the temporally modulated components into a substantially continuous beam. Additionally, or alternatively, time and/or position varying electric fields may be applied to the homogenisation device 4 in order to actively homogenise the beam. The time and/or position varying fields may comprise transient DC voltages or voltage waveforms or travelling waves. Travelling waves can be used to control or manipulate the residence times, velocities and/or position of ions within the homogenisation device 4. In this way, the components can be actively converted into a substantially continuous beam. Active homogenisation may allow a greater degree of control over the extent of homogenisation or the time required to homogenise an ion beam. Practical cycle times can be determined, for example, using calibration experiments or by extrapolating from programmable dynamic range enhancement ("pDRE") data. The pDRE technique is described in U.S. Pat. No. 7,683,314 (MICROMASS). For instance, a practical cycle time can be determined by alternately attenuating an ion beam for a time t1 and transmitting ions through the homogenisation device 4 (or a testing device having the same characteristics as the homogenisation device) for a time t2 and monitoring the output. Where the output is a continuous beam it can be seen that the ion beam has spread sufficiently within the homogenisation device 4 to remove the attenuation. By varying the attenuation time period t1, the temporal width that can be homogenised in the homogenisation device 4 (and hence suitable ramp cycle times) can be determined.

It may be desirable to drive ions through the homogenisation device 4 in order to reduce the overall transit time of ions. Ions may be driven or urged along the homogenisation device 4 for instance using axial fields or by applying one or more transient DC potentials or potential waveforms (travelling waves) although it is noted that any other means for driving ions known in the art may also be used. In these cases, the characteristics of the driving means e.g. the travelling waves or axial field should be arranged to ensure that the desired loss of temporal modulation occurs. This may typically involve operating the devices with relatively low axial fields or travelling wave heights or high travelling wave velocities. Typically, to ensure homogenisation within a travelling wave or axial field driven gas cell, cycle times of less than 10 ms may be appropriate. For fast instruments with relatively short spectral production and inter scan times, experiments have found that cycle times less than 2 ms, or less than 1 ms, provide better results i.e. dynamic range enhancements.

In the embodiment illustrated in FIG. 2 a separate homogenisation device 4 downstream of the collision cell 2 is used.

Figure 3:
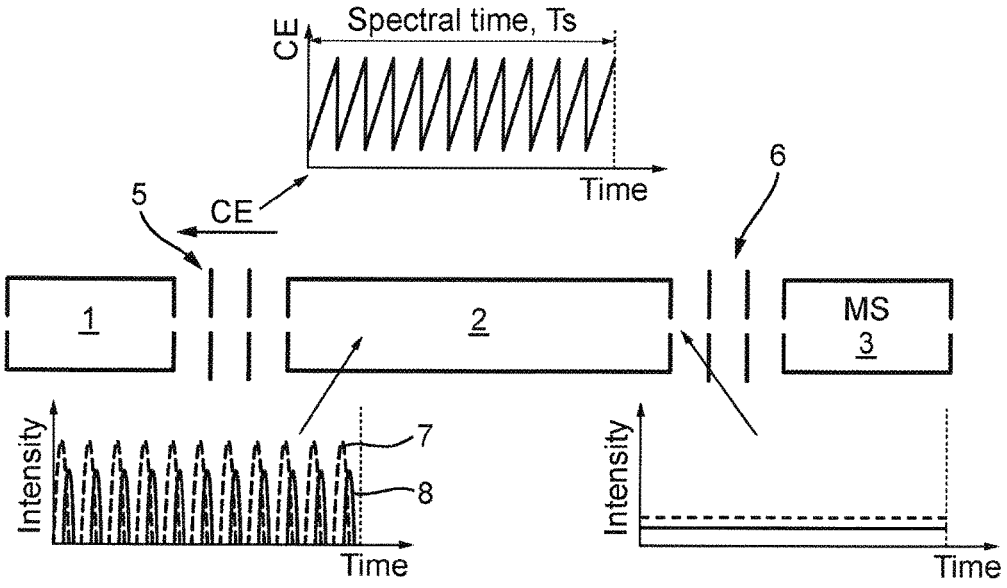
FIG. 3 shows schematically a mass spectrometer being operated in accordance with another embodiment.

In other embodiments, the fragmentation cell 2 being a gas-filled device may itself act to homogenise the ion beam in a similar manner to that described above. This is schematically illustrated in FIG. 3.

Again, the ramp cycle times and the conditions within the fragmentation cell 2 should be selected to ensure that the temporal profile can be sufficiently homogenised.

Whilst certain improvements have been described above specifically in relation to time of flight mass analysers, the various embodiments are not limited to any particular type of ion detection or acquisition system. Similar improvements may be achieved for other mass analysers which may advantageously be provided with a homogenised or continuous ion beam.

In particular, the techniques described herein may provide improvements in instruments employing a device having a relatively small transmission window or fill time downstream of the device that is being scanned. In these cases the downstream device effectively samples only a portion of the ion beam. Accordingly, where the ion beam is temporally modulated or uneven, the transmission window may not overlap with the temporal profile of some of the components. These components would not then be sampled. This may inadvertently introduce a bias into the measurement.

Figure 4:
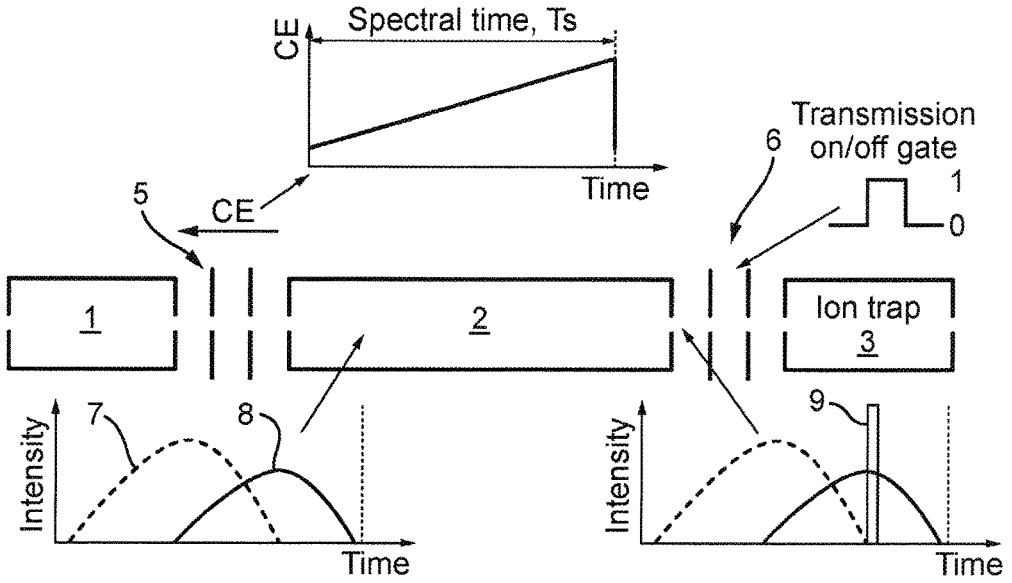
Fig. 4 Prior art
FIG. 4 shows schematically an ion trap mass spectrometer being operated in a conventional manner.

To illustrate this effect, FIG. 4 schematically shows a mass spectrometer where the mass analyser comprises an ion trap 3 operating with automatic gain control ("AGC") being operated in accordance with a known arrangement. In AGC ion traps the fill time of the ion trap is often a relatively short portion of the overall experimental cycle. The fill time of the ion trap is controlled by a transmission gate 6 disposed adjacently upstream of the ion trap 3.

In FIG. 4, like FIG. 1, the collision energy in the fragmentation cell 2 is ramped over the full period of a spectral acquisition as shown in the uppermost graph. This results in ions arriving at the ion trap 3 with temporally modulated intensity profiles as shown in the lower right graph. The transmission time window 9 of the ion trap is shown superimposed onto the intensity profiles.

The relatively long collision energy ramp again results in a wide temporal profile. The relatively short transmission window 9 only samples a portion of the ion beam i.e. only those components whose profiles overlap the window. The approach illustrated in FIG. 4 thus results in uneven sampling of the components of the ion beam. For instance, as shown in the lower right graph of FIG. 4, the fragment ion with intensity profile 7 (the dashed line) is not transmitted or sampled during the ion trap fill window 9. By scanning the collision energy in the fragmentation cell 2 a bias has been inadvertently introduced into the measurement. These problems can be avoided by the techniques described herein in accordance with various embodiments.

Figure 5:
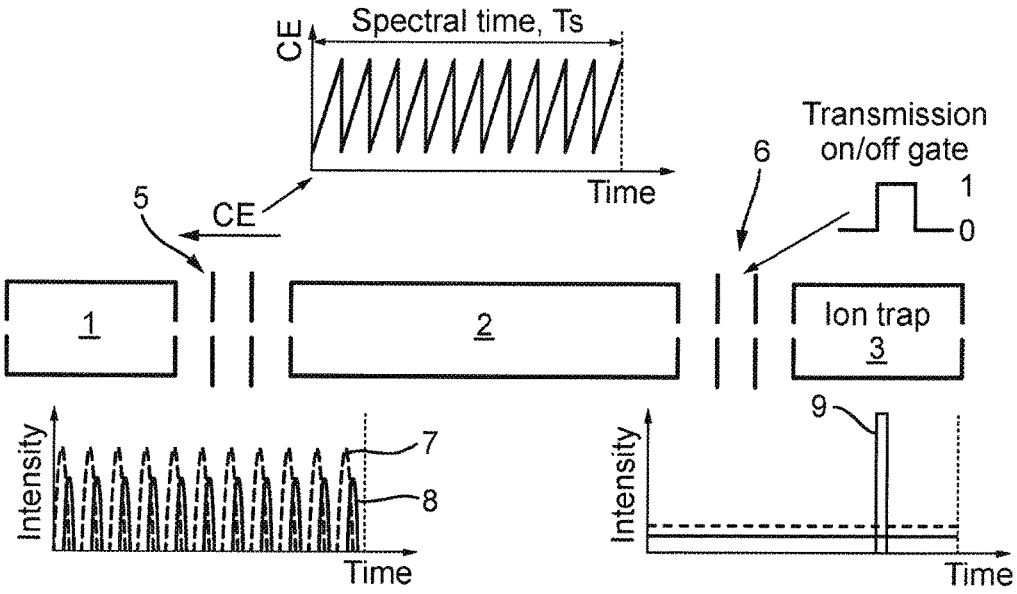
FIG. 5 shows schematically an ion trap mass spectrometer being operated in accordance with an embodiment.

FIG. 5 shows a mass spectrometer employing an ion trap being operated in accordance with an embodiment.

In a similar manner to that described above, the collision energy in FIG. 5 is repeatedly ramped over a relatively short cycle time and the resulting temporal modulation is removed or homogenised within the gas-filled fragmentation cell 2. Each of the components of the ion beam are thus provided to the ion trap as a continuous beam and are all evenly sampled by the ion trap 3 within the transmitted time window 9 (the lower right graph). Because the ion beam is continuous, the transmitted time window 9 can be made as short as desired whilst still ensuring that each of the components is measured.

Although in the embodiment shown in FIG. 5 the fragmentation cell 2 acts to homogenise the beam, it is noted that a downstream homogenisation device (like that illustrated in FIG. 2) may equally be used.

Figure 6:
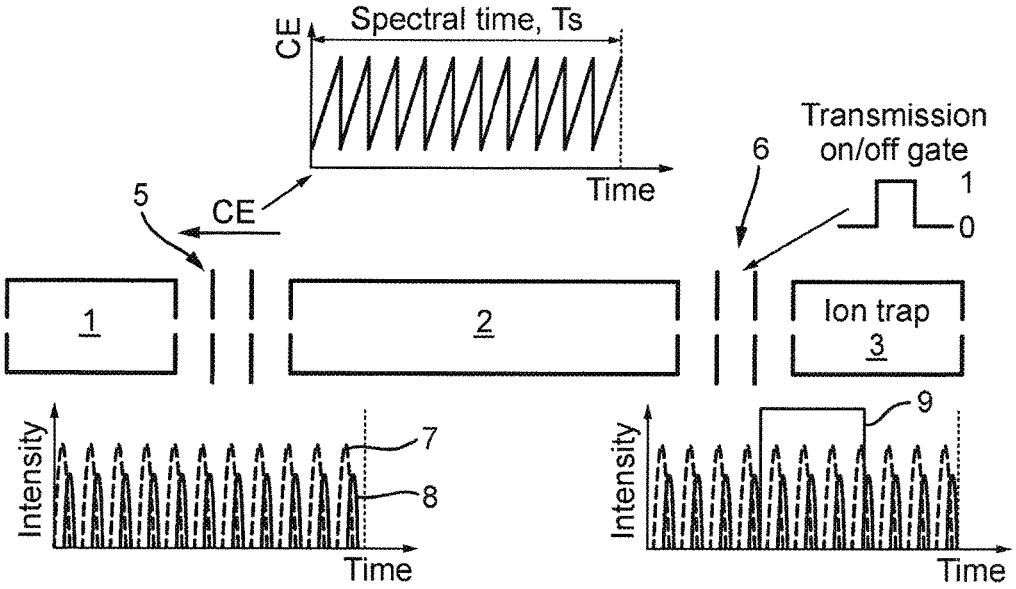
FIG. 6 shows schematically an ion trap mass spectrometer being operated in accordance with another embodiment.

Another embodiment is shown in FIG. 6. Here, the ion trap 3 forming the mass analyser acts as the homogenisation device.

Similarly, an additional ion accumulation device (not shown) may be disposed prior to the ion trap 3 or mass analyser and may be used to homogenise the beam.

In these cases, the parameter scan cycle time may be short enough to allow multiple ramps within the fill time or transmission window 9 of the ion trap 3 and/or ion accumulation device. For instance, as shown in the uppermost graph of FIG. 6 the parameter may be ramped or cycled multiple times within the fill time 9 of the ion trap 3. In this way, the full width of the temporal profile of the ion beam (i.e. of all of the components) can be sampled and each component of the ion beam measured. Any prior temporal profiles of the components will be lost once they are confined within a substantially homogeneous ion packet in the ion trap 3. The ions will tend to undergo collisional cooling within the ion trap 3 before they are mass analysed.

Figure 7:
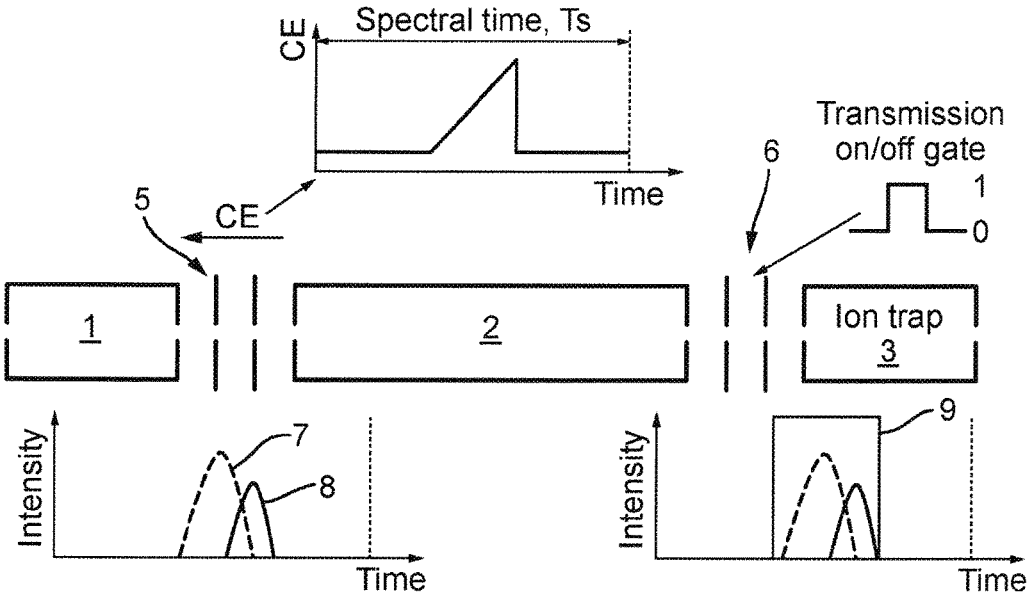
FIG. 7 shows schematically a further embodiment using an ion trap with a relatively long fill time.
Figure 8:
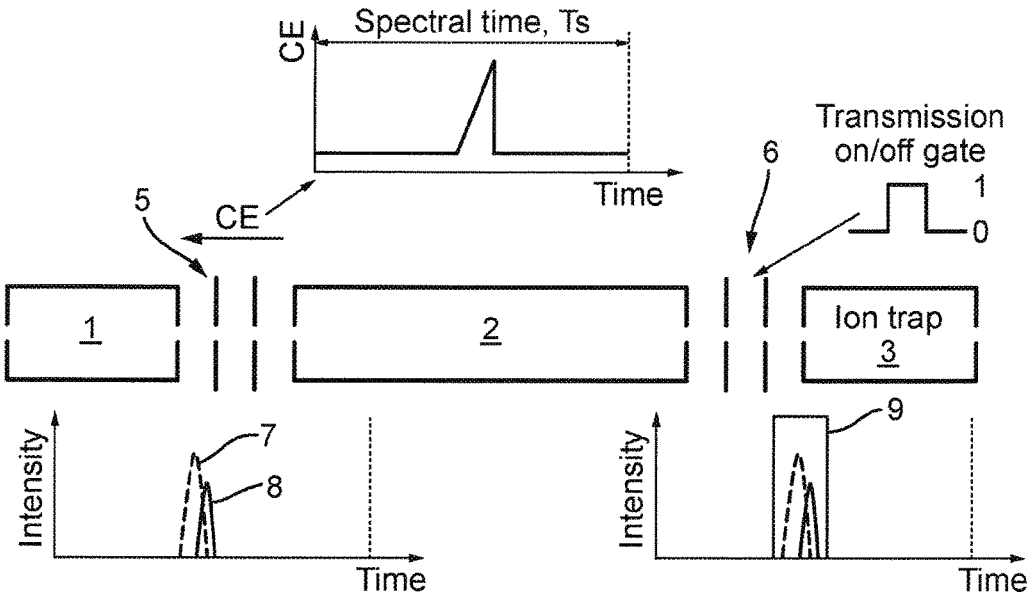
FIG. 8 shows schematically a further embodiment using an ion trap with a relatively short fill time.

In embodiments, the ramp cycle time may be selected to match the fill time window 9 i.e. so that one or more complete ramps can be performed within the fill window 9 of the ion trap 3. This is illustrated in FIGS. 7 and 8 for relatively long and short trap fill times respectively. Where the ramp cycle is matched or synchronised with the transmission window or fill time of a downstream device it may be necessary to account for the transit times of ions through any devices interspersed between the device being ramped and the downstream device. Although FIGS. 7 and 8 illustrate only a single ramp, it will be appreciated that the parameter may be ramped multiple times. The fill time may thus be selected to match or synchronise with one or more complete ramps i.e. to select the modulated components resulting from only one or more of the ramps.

The techniques described herein may also provide advantages where multiple parameters are scanned during the course of an acquisition. These parameters may be scanned with substantially different cycle times to achieve an effective nested instrument control apparatus. In these cases it is not necessary that downstream homogenisation is combined with each of the multiple parameter scans. However, by homogenising the ion beam in combination with at least one of the parameter scans it is possible to remove any biases that may otherwise result from inadvertent synchronisation of two or more scans/ramps of different parameters over a single scan time. This is a problem of current instruments that employ multiple scans of e.g. mass to charge profile and collision energy.

The approaches described above can work in conjunction with nested separations and acquisitions. In this case, the spectral acquisition time may be the nested spectral acquisition time.

The modulation cycle (i.e. the ramp cycle time) may be synchronised with or matched to the spectra production cycle.

The instrument geometry and the nature and number of components described above are not intended to be limiting. For instance, although embodiments have been described which employ a CID fragmentation cell, the techniques may also apply to any device that may be scanned or varied in a similar manner. This may include any type of fragmentation or reaction device where scanning a fragmentation or reaction parameter introduces a temporal modulation such as those mentioned previously. The technique may also apply to RF ion guides or filtering devices in which case an RF and/or DC voltage may be scanned to vary the range of mass to charge values being transmitted. This results in a mass to charge range dependent temporal profile.

Although the present invention has been described with reference to particular embodiments, it will be understood by those skilled in the art that various changes in form and detail may be made without departing from the scope of the invention as set forth in the accompanying claims.

The invention claimed is:

1. A method of mass spectrometry comprising:

passing an ion beam containing a mixture of components through a first device;

recording a mass spectrum of at least some of said components with a single spectrum production time Ts;

during a single spectrum production cycle, scanning a parameter of said first device over a range of values with a cycle time $T1<Ts$, wherein different components are transmitted through or produced in the first device at different values of the parameter such that scanning said parameter introduces a temporal modulation or profile to said components; and prior to recording said mass spectrum, substantially removing or altering said temporal modulation or profile by converting the temporally modulated components into a substantially continuous or pseudo-continuous ion beam or by converting the temporally modulated components into a substantially homogeneous ion packet.

2. A method as claimed in claim 1, comprising converting the temporally modulated components into a substantially continuous or pseudo-continuous ion beam by passing the components through or along a gas-filled homogenisation device.

3. A method as claimed in claim 2, wherein said gas-filled homogenisation device comprises: (i) a gas cell; (ii) a gas-filled RF or AC device; (iii) an ion guide, ion guiding region or ion funnel; or (iv) a fragmentation or reaction cell.

4. A method as claimed in claim 2, wherein said gas-filled device: (i) constitutes or is said first device; (ii) is disposed downstream of said first device and/or between said first device and an ion detection or acquisition system or mass analyser; or (iii) constitutes or is an ion detection or acquisition system or mass analyser.

5. A method of mass spectrometry as claimed in claim 1, wherein said components are converted into a substantially homogeneous ion packet by passing the components into or through an ion trap or ion accumulation device.

6. A method as claimed in claim 1, wherein said cycle time T1 is less than: (i) 10 ms; (ii) 5 ms; (iii) 2 ms; or (iv) 1 ms.

7. A method as claimed in claim 1, comprising:

passing the ion beam to a mass analyser for recording said mass spectrum; and wherein said temporally modulated components are converted into a substantially continuous or pseudo-continuous ion beam and/or a substantially homogeneous ion packet before the ion beam is passed to the mass analyser.

8. A method as claimed in claim 1, further comprising matching said cycle time T1 to a transmission window, extraction window or fill time, Tf, of a second device disposed downstream of said first device, so that $T1 \leq Tf < Ts$.

9. A method as claimed in claim 1, further comprising scanning said parameter of said first device multiple times during said single spectrum production cycle.

10. A method as claimed in claim 1, wherein said first device comprises: (i) a collision cell wherein the parameter is collision energy; (ii) a fragmentation or reaction cell wherein the parameter is a fragmentation or reaction parameter; (iii) an ion guide wherein the parameter is a DC, AC or RF potential that controls or changes ion transmission through the ion guide; or (iv) an ion filter wherein the parameter is a DC or RF potential that controls or changes ion transmission through the ion filter.

11. A method as claimed in claim 1, further comprising passing said components from said first device onwards to a mass analyser for recording the mass spectrum, wherein said mass analyser is optionally selected from the group comprising: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

12. A method as claimed in claim 1, wherein the step of scanning said parameter comprises increasing, decreasing or varying said operating parameter in a linear, non-linear, or stepped manner.

13. A method as claimed in claim 1, further comprising scanning a second parameter of said first device and/or of a further device through which the ion beam passes with a cycle time T2, wherein $T2 \neq T1$.

14. A mass spectrometer comprising:

a first device having a variable operating parameter;

a mass analyser that records a mass spectrum of ions after they have passed through said first device with a single spectrum production time Ts;

a control system arranged and adapted to scan said parameter of said first device with a cycle time $T1 < Ts$ during a single spectrum production cycle, wherein different components are transmitted through or produced in the first device at different values of the parameter such that scanning said parameter introduces a temporal modulation or profile to said components; and one or more homogenisation devices for substantially removing or altering said temporal modulation or profile from said components prior to their mass analysis.

15. A method of mass spectrometry comprising:

passing an ion beam through a first device;

during a single spectrum production cycle, scanning a parameter of said first device multiple times over a range of values with a cycle time T1, wherein different components are transmitted through or produced in the first device at different values of the parameter such that scanning said parameter introduces a temporal modulation or profile to said components;

passing the temporally modulated components through or along a gas-filled homogenisation device to substantially remove or alter said temporal modulation or profile; and then recording a mass spectrum of at least some of said components.

16. A method as claimed in claim 15, wherein said homogenisation device converts said temporally modulated components into a substantially continuous or pseudo-continuous ion beam.

17. A mass spectrometer as claimed in claim 14 wherein said control system is arranged and adapted to during a single spectrum production cycle, scan said parameter of said first device multiple times with said cycle time T1.

18. A mass spectrometer as claimed in claim 14 wherein said one or more homogenisation devices are arranged and adapted to convert the temporally modulated components into a substantially continuous or pseudo-continuous ion beam.

19. A mass spectrometer as claimed in claim 14 wherein said one or more homogenisation devices are arranged and adapted to convert the temporally modulated components into a substantially homogenous ion packet.

20. A method as claimed in claim 15, wherein said homogenisation device converts said temporally modulated components into a substantially homogenous ion packet.

* * * * *